US008772208B2

(12) United States Patent
Fukutomi et al.

(10) Patent No.: US 8,772,208 B2
(45) Date of Patent: Jul. 8, 2014

(54) ADDITIVE AGENT, OIL FILTER AND LUBRICATING DEVICE FOR MACHINE

(75) Inventors: Ippei Fukutomi, Machida (JP); Norio Inami, Susono (JP); Kenichi Harada, Susono (JP); Motoichi Murakami, Gotenba (JP); Koji Morita, Mishima (JP); Takahiko Fujiwara, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 126 days.

(21) Appl. No.: 13/379,877

(22) PCT Filed: Mar. 18, 2011

(86) PCT No.: PCT/JP2011/001634

§ 371 (c)(1),
(2), (4) Date: Dec. 21, 2011

(87) PCT Pub. No.: WO2012/127517

PCT Pub. Date: Sep. 27, 2012

(65) Prior Publication Data

US 2012/0238480 A1 Sep. 20, 2012

(51) Int. Cl.
*C07F 3/00* (2006.01)

(52) U.S. Cl.
USPC ..... 508/381; 508/154

(58) Field of Classification Search
USPC ..... 508/110, 154
See application file for complete search history.

(56) References Cited

U.S. PATENT DOCUMENTS

| | | | |
|---|---|---|---|
| 4,340,493 | A | 7/1982 | Miyata |
| 6,024,880 | A | 2/2000 | Ciora, Jr. et al. |

FOREIGN PATENT DOCUMENTS

| | | | | |
|---|---|---|---|---|
| EP | 0 063 631 | A | | 11/1982 |
| JP | 56-129297 | A | | 10/1981 |
| JP | 57-002359 | A | | 1/1982 |
| JP | 57002359 | A | * | 1/1982 |
| JP | 03-296408 | A | | 12/1991 |
| JP | 2001-089784 | A | | 4/2001 |
| WO | WO 00/053705 | A | | 9/2000 |
| WO | WO 2005/066320 | A1 | | 7/2005 |

* cited by examiner

*Primary Examiner* — Taiwo Oladapo
(74) *Attorney, Agent, or Firm* — Sughrue Mion, PLLC

(57) ABSTRACT

The present invention provides an additive agent to be added to oil and comprising weak basic hydrotalcite. At the time of adding a mixture of hydrotalcite of 1 weight % and water by 3 weight % to the oil where a hydrogen ion exponent is within a range of 6 to 7 for stirring, the weak basic hydrotalcite is hydrotalcite where the obtained oil indicates the hydrogen ion exponent within a range of 6 to 7. Such an additive agent can be accommodated in an oil filter (36) for use.

8 Claims, 8 Drawing Sheets

ADDITIVE AGENT, OIL FILTER AND LUBRICATING DEVICE FOR MACHINE

CROSS REFERENCE TO RELATED APPLICATIONS

This application is a National Stage of International Application No. PCT/JP2011/001634 filed Mar. 18, 2011, the contents of which are incorporated herein by reference in their entirety.

TECHNICAL FIELD

The present invention relates to an additive agent to be added to oil used in a machine such as an engine, and an oil filter with the additive agent and a lubricating device for a machine with the additive agent.

BACKGROUND ART

Various kinds of oil additive agents are put into oil used in a machine such as an engine. For example, ZnDTP which is zinc dialkyldithiophosphate is added to oil and has an antioxidant capability, a corrosion prevention capability, an antiwear capability, and the like.

On the other hand, PTL 1 discloses use of hydrotalcite expressed by the following formula (1) as an oil additive agent.

$$Mg_xAl_2(OH)_{6+2x-2y}(CO_3)_y \cdot mH_2O \quad (1)$$

Where, in the formula (1), x and y are integral numbers satisfying $3<x<20$ and $0<y<2$, and m indicates an integral number. The hydrotalcite expressed by the above formula (1), according to the description of PTL 1, has characteristics of quickly reacting to an acid pollutant undesirable in the oil and indicates alkalinity value having acid value of 250 or more in the oil.

PTL 2 discloses filter media for a bypass oil filter for an internal combustion engine. According to the description of PTL 2, the filter media comprises a hydrotalcite compound expressed by the above formula (1).

CITATION LIST

Patent Literature

PTL 1: Japanese Patent Laid-Open No. Sho 56-129297 (1981)

PTL 2: Japanese Patent Laid-Open No. Hei 03-296408 (1991)

SUMMARY OF INVENTION

Incidentally the above ZnDTP has characteristics of being susceptible to hydrolysis and is a substance of hydrolyzing. Therefore, for example, when hydroxide components such as hydroxide ions are present in the periphery, there are some cases where the ZnDTP hydrolyzes in the oil, and as a result, the effect of the ZnDTP is reduced. Therefore, in a case of adding a substance of hydrolyzing, such as ZnDTP, to the oil as an oil additive agent, it is desirable to reduce an amount of the hydroxide components in the oil.

On the other hand, the hydrotalcite described in PTL 1 and PTL 2 has characteristics of emitting many hydroxide ions in the oil and therefore indicates a strong basic to the oil.

Accordingly, the hydrotalcite described in PTL 1 and PTL 2 has poor compatibility with the oil additive agent of hydrolyzing.

Therefore, the present invention is made in view of the foregoing problem, and an object of the present invention is to provide an additive agent which can be added to oil in such a manner as to remove acid components in the oil and can be used together with an additive agent which hydrolyzes in the oil.

An aspect of the present invention is to provide an additive agent to be added to oil, comprising weak basic hydrotalcite. The additive agent can be added to oil in such a manner as to remove acid components in the oil and can be used together with an additive agent which hydrolyzes in the oil.

Preferably at the time of adding a mixture of hydrotalcite of 1 weight % and water by 3 weight % to oil where a hydrogen ion exponent is within a range of 6 to 7 for stirring, the weak basic hydrotalcite may be hydrotalcite where the obtained oil indicates a hydrogen ion exponent within a range of 6 to 7. In addition, the weak basic hydrotalicite may be hydrotalcite where a mixture of hydrotalcite of 3 weight % and water indicates a hydrogen ion exponent of 7 or more to 10 or less.

The weak basic hydrotalcite may have a composition of $$Mg_{8-x}Al_x(OH)_y(CO_3)_z \cdot mH_2O$$

(where, in the formula, x is 1 or more to 7 or less, y, z and m are positive rational values, and z is more than y). In addition, for example, x may be 2, y may be 1 and z may be 16.

A different aspect of the present invention provides an oil filter comprising the aforementioned additive agent. The oil filter may further comprise an additive agent of hydrolyzing.

A further different aspect of the present invention provides a lubricating device for a machine comprising the aforementioned additive agent. The lubricating device for the machine may further comprise an additive agent of hydrolyzing. Such a lubricating device for the machine may be provided with the aforementioned oil filter.

The aforementioned and further features and advantages of the present invention will be apparent from the description of exemplified embodiments with reference to the accompanying drawings below.

DESCRIPTION OF EMBODIMENTS

The present invention relates to an additive agent to be added to oil. The additive agent according to the present invention comprises weak basic hydrotalcite. Such an additive agent can be directly added into the oil. For example, the additive agent can be directly added into oil in a lubricating device of a machine such as an internal combustion engine. In addition, the additive agent may be used to be accommodated in a cartridge. For example, the additive agent is provided in an oil filter. The cartridge of such an oil filter or the like may be fixed to or replaceably installed in an oil passage in the lubricating device of the machine such as the internal combustion engine. The hydrotalcite in the additive agent is an anionic ion exchanger and has a capability of removing acid components from the oil, that is, a capability of trapping the acid components in the oil. In addition, the hydrotalcite can be used together with substances which hydrolyze, and the additive agent can be applied to the cartridge or the lubricating device together with such a substance.

Figure 1:
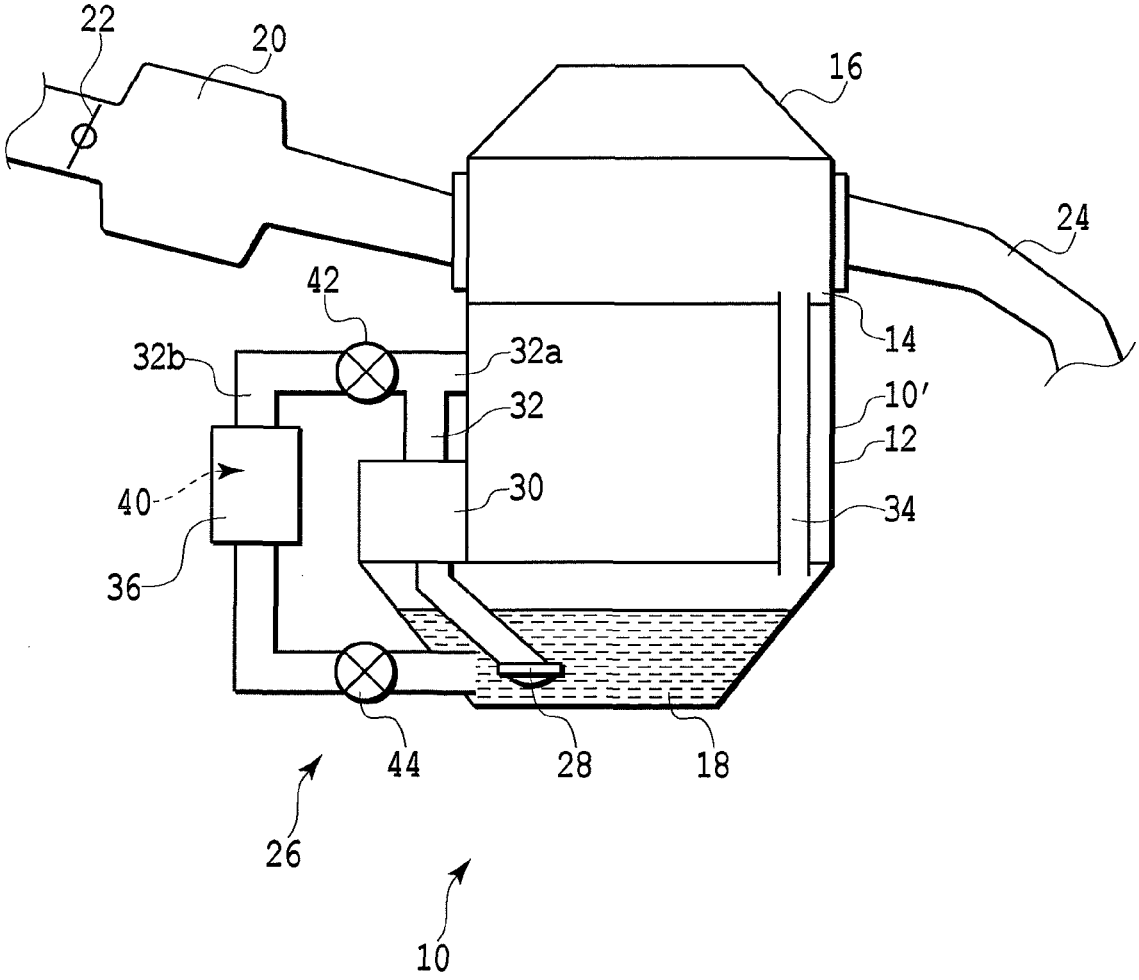
FIG. 1 is a concept diagram of an internal combustion engine to which an embodiment according to the present invention is applied.

Hereinafter, an internal combustion engine (hereinafter, engine) 10 to which an embodiment according to the present invention is applied will be explained. The engine 10 is schematically shown in FIG. 1. Here, the engine 10 is mounted on a vehicle. However, the engine 10 in the present embodiment is an in-line four-cylinder engine, but an engine to which the present invention is applied may have not only any cylinder number and any cylinder arrangement form but also may be a spark ignition type engine or a compression ignition type engine.

The engine 10 is provided with a cylinder block 12 provided integrally with a crank case, a cylinder head 14, a head cover 16 covering the cylinder head 14 from above, and an oil pan 18. A mixture of air sucked in via a throttle valve 22 in an intake passage 20 and fuel injected from a fuel injection valve is burned in a combustion chamber, and an exhaust gas thereof is discharged through an exhaust passage 24.

A lubricating device 26 of the engine 10 is constructed to supply oil to a plurality of supply regions including a plurality of sliding portions in the engine 10. The lubricating device 26 is provided with a strainer 28 and an oil pump 30, and the oil staying in the oil pan 18 is sucked up (sucked in) through the strainer 28 by the oil pump 30. The oil sucked up in this way is supplied via an oil filter (not shown) through an oil passage 32 (including a plurality of oil paths corresponding to the respective supply regions) formed in the engine 10 to components within the engine 10, for example, cam shaft journals, crank journals, connecting rods, and pistons. The lubricating oil supplied to the plurality of the components, that is, the oil is finally returned to the oil pan 18 under its own weight. It should be noted that a space in which the oil thus flows in such a manner as to circulate within the engine 10 is herein called "oil passage".

An oil-returning passage 34 is formed in the cylinder block 12 and the cylinder head 14 to communicate an inside of the head cover 16 or an inside of the cylinder head 14 with an inside of the crank case, that is, an inside of the oil pan 18. The oil-returning passage 34 is, for example, a passage for returning (dropping) the oil having finished lubrication to a valve operating system from the cylinder head 14 into the oil pan 18, as well as a passage for moving upward a blow-by gas in the crank case toward an inside of the head cover 16. It should be noted that the number of the oil-returning passage 34 may be arbitrary.

Here, the blow-by gas means a gas which leaks out from a clearance between a piston ring of the piston and a cylinder bore of the cylinder block 12 into the crank case. The blow-by gas contains a great number of hydrocarbons or water components. Therefore, too many blow-by gases cause early deterioration of engine oil or rust of the engine inside. In addition, since hydrocarbons are contained in the blow-by gas, it is not desirable environmentally to release the blow-by gas into an atmosphere as it is. Therefore, the engine 10 is provided with the known blow-by gas recirculation device (not shown). The blow-by gas is introduced into the head cover 16, and thereafter is forcibly returned to an intake system by using an intake negative pressure, which is supplied to the combustion chamber.

Incidentally such a blow-by gas includes, for example, NOx, Sox and water components. For example, since the head cover 16 is constructed such that heat from the engine is hard to be transmitted thereto and an outer surface thereof is exposed to an outside air to be cooled by cooling wind or the like, condensed water is easy to be generated on an inner surface of the head cover 16 by dew condensation or the like. Therefore, particularly in the head cover 16, acid substances, for example, nitric acids and sulfuric acids are easily generated due to the reaction of these components. These acid substances can be mixed with the lubricating oil, that is, the engine oil to promote generation, adhesion, and accumulation of sludge precursors and sludge inside of the engine.

Therefore, for removing such acid substances, that is, acid components from the engine oil, the lubricating device 26 in the engine 10 is provided with an oil filter 36. It should be noted that the lubricating device 26 is shown diagrammatically to be only partly exaggerated in FIG. 1. The lubricating device 26 has the oil passage 32 including the oil-returning passage 34 and the inside of the oil pan 18 in the engine 10 and is provided with the oil filter 36 in the middle of the oil passage 32.

However, in FIG. 1, for showing a part of the lubricating device 26 including the oil filter 36 in the embodiment in an exaggerated way, a part of the lubricating device 26 including the oil filter 36 is drawn outside of an engine body 10'. However, the installation position of the oil filter 36 or the like is not limited to the position shown in FIG. 1, and can be changed variously, for example, can be placed in the known oil filter installation position, or for example, can be placed in a section having contact with an outside of each component in the engine body 10' or inside thereof. However, in the present embodiment, the oil filter 36 is provided replaceably and is placed in a position of being capable of being easily replaced from an outside.

The oil passage 32 comprises a main oil passage 32*a* for supplying oil to the plurality of the supply regions in the engine 10 and a sub oil passage (bypass passage) 32*b* connected to the main oil passage 32*a*. The oil filter 36 is positioned in the sub oil passage 32*b*. However, the oil filter 36 may be provided in the main oil passage 32*a*, for example, may be provided in the oil-returning passage 34. It should be noted that the oil having flowed into the sub oil passage 32*b* can finally flow into the oil pan 18 under its own weight.

Figure 2:
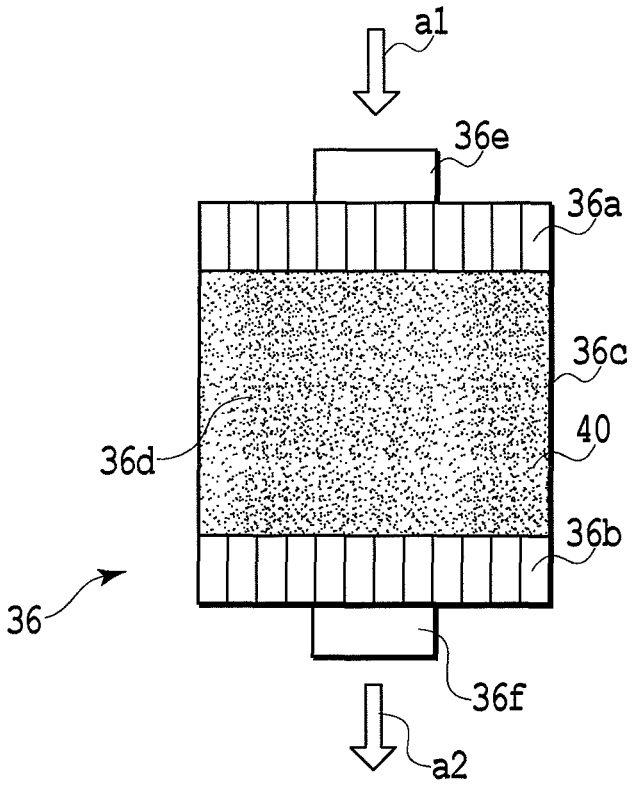
FIG. 2 is an enlarged schematic diagram of an oil filter in a lubricating device of the internal combustion engine in FIG. 1.

The aforementioned oil filter 36 in such a lubricating device 26, as shown in FIG. 2, comprises filter portions 36*a* and 36*b*, an accommodation portion (accommodation chamber) 36*d* defined by an outer shell member 36*c* and the filter portions 36*a* and 36*b* so as to be interposed between the filter portions 36*a* and 36*b*, an inlet port 36*e*, and an outlet port 36*f*. Each of the filter portions 36*a* and 36*b* is made of a filter member and herein specifically has a plurality of pores which extend substantially in the flow path direction (directions of arrows a1 and a2 in FIG. 2) and through which oil can flow. The filter portions 36*a* and 36*b* are provided in such a manner as to trap solid materials such as solid particles in the oil. In addition, each of the filter portions 36*a* and 36*b* is provided to maintain a configuration and a size of the accommodation portion 36*d*, and to protect and retain a plurality of additive agents 40, that is, substances provided within the accommodation 36*d*. It should be noted that the additive agent 40 may be called a reactant or filter body.

It should be noted that the oil filter 36 is not limited to such a construction, and may be variously constructed such that the oil filter 36 accommodates the additive agents 40 therein and that oil can make contact with the additive agent accommodated therein in the lubricating device 26 of the engine 10. For example, in the oil filter, a wire-netting case, a bag-shaped case formed using woven metal wires, resins or the like, a mesh type tubular case (having an accommodation region between an inner tube and an outer tube) or the like is used, wherein an accommodation portion can be formed inside to incorporate a plurality of additive agents therein. The oil filter can be provided with various types of filter media. In addition, the additive agent can be mixed into the filter media for the holding. For example, in a case where the filter media is made of fibrous substances, the additive agent can be fixed or retained in an empty space in the filter media. The oil filter 36 can be constructed to have the construction similar to that of the known oil filter as a main construction and to be provided with the additive agent 40 therein.

The plurality of the additive agents 40 accommodated in the accommodation portion 36*d* comprise hydrotalcite (acting as ion exchangers) as ion exchangers (ion exchange materials). The hydrotalcite has a capability of absorbing predetermined ions (ion components). In other words, the additive agent 40 in the accommodation portion 36*d* has such a capability of absorbing the predetermined ion to remove the predetermined ion from the engine oil. Specifically the hydrotalcite is used for removing nitrate ions ($NO_3^-$) which can be generated by NOx and water in the blow-by gas and sulfate ions ($SO_4^{2-}$) which can be generated by SOx and water in the blow-by gas, from the oil. It should be noted that acid components which are desirable to be removed from the oil by the hydrotalcite comprise not only nitrate ions ($NO_3^-$) and sulfate ions ($SO_4^{2-}$) but also, for example, acetate ions ($CH_3COO^-$) which can be generated based upon blow-by gases and formic acid ions ($HCOO^-$) which can be likewise generated based upon blow-by gases. The hydrotalcite can have a capability of absorbing at least one component selected from a group including these components or a group composed of these components.

In consequence, when the oil passes through the oil filter 36 provided in the lubricating device 26, the aforementioned acid component in the oil can be removed from the oil based upon the function of the plurality of the additive agents 40 in the oil filter 36. Therefore, generation of sludge precursors and sludge can be suppressed in the engine 10.

In addition, the oil filter 36 can be replaced as described above. Valves 42 and 44 are provided after and before the oil filter 36 in such a manner that the oil does not flow in the installation portion of the oil filter 36, herein in the sub oil passage 32*b* at the replacing. Each of the valves 42 and 44 is a control valve herein and opens/closes by an operation of an actuator actuating based upon a signal from an electronic control unit (not shown) having a function as a control device in the engine 10. At the replacement of the oil filter 36, for example, when a successive operating time of the engine 10 reaches a predetermined time, the valves 42 and 44 are respectively closed to light up an alarm or the like, making it possible to induce a driver to replace the oil filter. It should be noted that the valves 42 and 44 respectively may be a manual type opening/closing valves.

Here, the additive agent 40 will be explained. The hydrotalcite is accommodated as the additive agent 40 in the oil filter 36 as described above. Other various types of substances may be contained as the additive agent 40 in addition to the hydrotalcite, and herein ZnDTP as an oil additive agent is accommodated together in the oil filter 36. However, it is possible to use only the hydrotalcite as the additive agent 40, and only the hydrotalcite as the additive agent can be accommodated in the oil filter 36. The hydrotalcite is herein a powdered element, more specifically made of microscopic particles, each having a size in a range of 0.001 mm or more to 1 mm or less. Preferably each hydrotalcite may have a size of 0.1 mm to 1 mm. It should be noted that the oil filter 36 is constructed such that such hydrotalcite does not leak out from the oil filter 36. However, the hydrotalcite may not be the powdered element, but may be constructed as an integral block element having a predetermined configuration to be accommodated in the oil filter 36. Since the engine oil flows in the oil filter 36, it is required that the hydrotalcite is endurable to a temperature of the engine oil. The hydrotalcite can be endurable to use in a temperature range of 160° C. or less (for example, 0° C. or more), and preferably can be used in a temperature of 100° C. or less.

Incidentally the hydrotalcite herein is a layered compound including layers of backbone portions composed of Al and Mg as main components and negative ions sandwiched between the layers. In some cases, the hydrotalcite is called a hydrotalcite-like compound. The hydrotalcite has a function as an ion exchanger, and a capability of absorbing acid components (the above nitrate ions and the like) in the oil, in the oil and releasing negative ions instead.

The hydrotalcite can comprise hydroxide ions ($OH^-$) and carbonate ions ($CO_3^{2-}$) as negative ions between the layers. There are some cases where the hydroxide ions and the carbonate ions are released from the hydrotalcite when the hydrotalcite is in the water or in the oil. The hydroxide ion and the carbonate ion can increase a base of the released liquid, and particularly the hydroxide ion can strongly increase the base of the liquid.

Herein, the hydrotalcite in the present invention is weak basic hydrotalcite. The weak basic hydrotalcite is hydrotalcite in which, when a mixture of the hydrotalcite of 1 weight % and water is added by 3 weight % to oil having a hydrogen ion exponent (pH) of 6 to 7 for stirring, the obtained oil shows pH of 6 to 7. In addition, the weak basic hydrotalcite is hydrotalcite in which a mixture of hydroytalcite of 3 weight % and water shows a hydrogen ion exponent of 7 or more to 10 or less.

Such weak basic hydrotalcite has a composition of containing more carbonate ions as compared to the hydroxide ions. An example of such hydrotalcite includes "$Mg_6Al_2(OH)(CO_3)_{16}$". Such hydrotalcite can generally exist as a hydrate, and, for example, can be expressed as "$Mg_6Al_2(OH)(CO_3)_{16}.mH_2O$ (however, m is a positive rational number)". It should be noted that a composition ratio of carbonate ions and hydroxide ions in the hydrotalcite in the present invention (carbonate ions/hydroxide ions) may be larger than 1, preferably 15 or 16 or more. In the present invention, a ratio of Mg and Al in the hydrotalcite may be any value.

In other words, such weak basic hydrotalcite can have the composition according to the following formula (2).

$$Mg_{8-x}Al_x(OH)_y(CO_3)_z.mH_2O \quad (2)$$

In the formula (2), x is a value of 1 or more to 7 or less, and y, z, and m are positive rational values, and z is more than y. Preferably x is a value of 2 or more to 5 or less.

This hydrotalcite relatively comprises a small amount of hydroxide ions and a great amount of carbonate ions. Therefore, such hydrotalcite never releases a great number of hydroxide ions in the oil. On the other hand, the hydrotalcite releases carbonate ions, which become gases mainly such as carbon dioxides. Therefore, ZnDTP put in the oil filter 36 as an additive agent together with the hydrotalcite is a substance of hydrolyzing, but the degree of promoting the decomposition of the ZnDTP by the weak basic hydrotalcite does not matter. Therefore, the hydrotalcite can be used together with the other substance of hydrolyzing, particularly an oil additive agent. It should be noted that as the additive agent of hydrolyzing, there is an additive agent generating an acid substance by the hydrolyzing. Such an additive agent, for example, hydrolyzes, thereby generating acid substances such as $SO_4^{2-}$ or $NO_3^-$, in other words, acid decomposition substances. The above hydrotalcite can be preferably used together with such an additive agent.

Hereinafter, several examples out of experiments performed for examining properties and function effects of the above weak basic hydrotalcite will be explained. In the following experiments, "$Mg_6Al_2$ (OH) $(CO_3)_{16}$" (hereinafter, called "HT") of the above composition made by Wako Pure Chemical Industries, Ltd. was used as the hydrotalcite within the scope of the present invention. In addition, in the experiment, hydrotalcite "$Mg_6Al_2$ $(OH)_{17}$ $(CO_3)$" (hereinafter, called "strong HT") made by Aldrich Co. out of the scope of the present invention was used as an additive agent to be compared. Further, in the experiment, weak basic zirconium oxycarbonate, that is, "$ZrOCO_3.ZrO_2.nH_2O$ (however, n is an integral number)" was used as an additive agent to be compared. In addition, in the experiment, 5W30 of Castle (registered trademark) made of Toyota Motor Co., Ltd. was used as unused oil. In addition, oil of an on-board engine which continued to be used till an urban travel distance reached 30,000 km in an experiment vehicle was used as oil (deteriorated oil) deteriorated in the following experiment. It should be noted that the above 5W30 was used as engine oil in the engine mounted on the experiment vehicle.

It should be noted that excellent properties of HT and excellent effects by HT as an oil additive agent will be specifically explained hereinafter. The hydrotalcite which can be expressed in the above formula (2) includes the HT and has properties similar to the following properties of HT, and will achieve excellent effects similar to the following effect by HT.

Experiment Example 1

First, the result of experiments performed for examining properties of each of HT and strong HT in unused oil will be explained. The experiment result is shown in FIG. 3.

Figure 3:
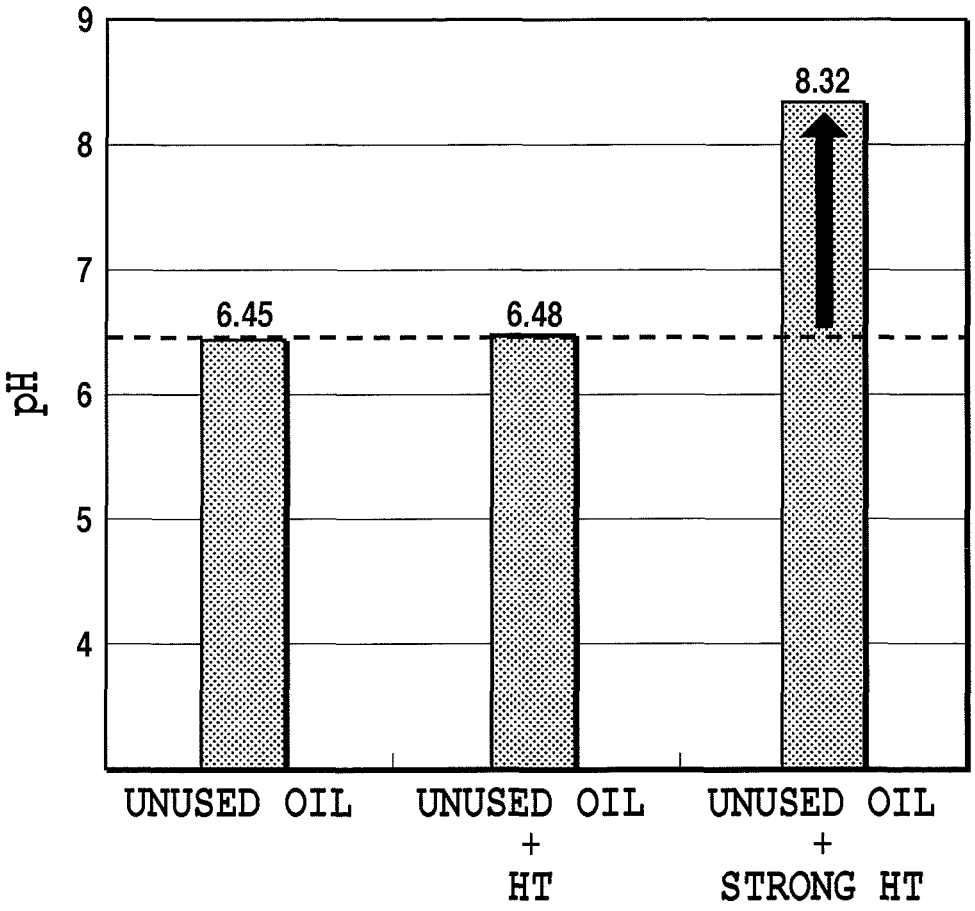
FIG. 3 is a graph showing an experiment result.

In this experiment, a mixture of HT of 1 weight % and water was added by 3 weight % to unused oil of which a hydrogen ion exponent is within a range of 6 to 7 for stirring, to produce experimented oil 11 ("unused oil+HT" in FIG. 3). In addition, a mixture of strong HT of 1 weight % and water was added by 3 weight % to the same unused oil for stirring, to produce experimented oil 12 ("unused oil+strong HT" in FIG. 3). pH of each of the oil 11 and 12 obtained thus was measured.

In FIG. 3, pH of unused oil 13 is shown together with pH of each of the oil 11 and 12. The unused oil 13 is neutral because of pH of 6.45, and the oil 11 to which HT was added was neutral because of pH of 6.48. In this manner, HT does not release ions as many as to raise a problem in the unused oil. On the other hand, the oil 12 to which strong HT was added was clearly alkaline because of pH of 8.32. In this manner, strong HT is strong basic, and has characteristics of releasing a great number of hydroxide ions to oil, and therefore is not suitable for use together with ZnDTP.

In this manner, HT is hydrotalcite in which, when a mixture of HT of 1 weight % and water is added by 3 weight % to oil having pH of 6 to 7 for stirring, the obtained oil shows pH of 6 to 7.

In addition, a mixture of HT of 3 weight % and water (distilled water) showed pH of 7 or more to 10 or less. On the other hand, a mixture of the same amount of strong HT and water showed pH of 11 or more.

Experiment Example 2

Next, the result of experiments performed for examining properties of each of HT and strong HT in unused oil will be explained. The experiment result is shown in FIG. 4.

Figure 4:
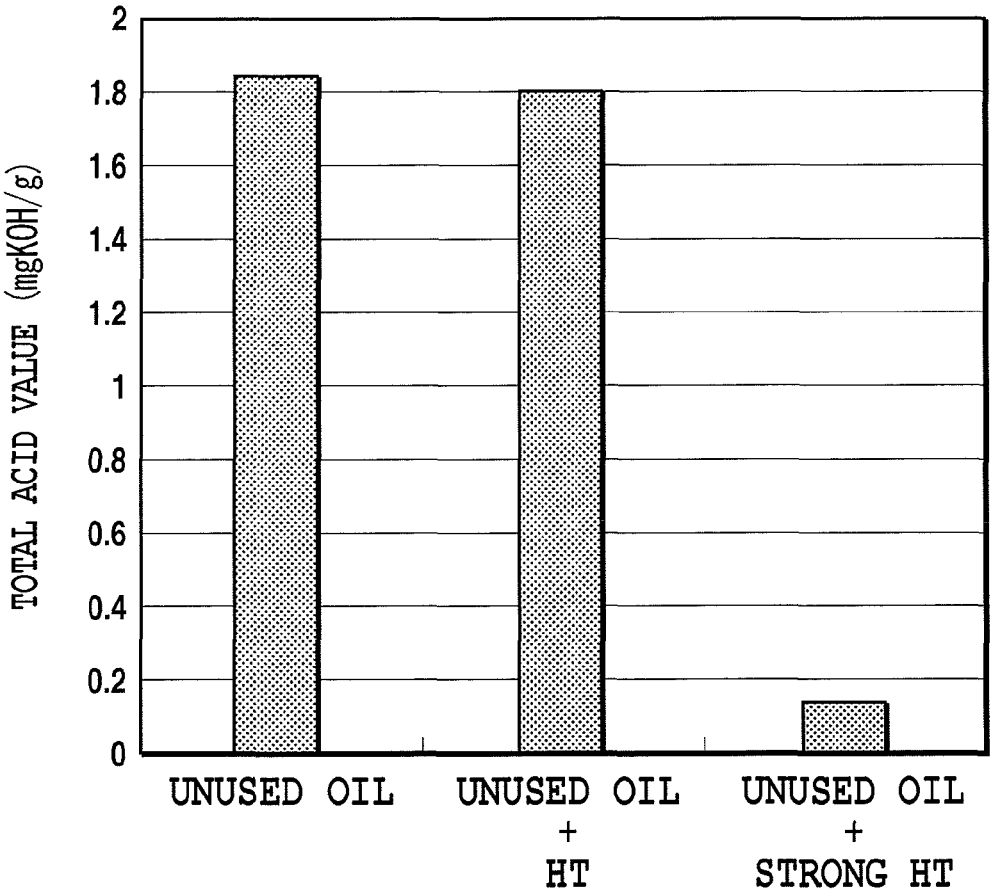
FIG. 4 is a graph showing an experiment result.

In this experiment, mixture oil in which HT of 1 g was added to unused oil of 30 g for stirring was maintained at a temperature of 95° C. for 12 hours to produce experimented oil 21 ("unused oil+HT" in FIG. 4). Likewise mixture oil in which strong HT of 1 g was added to unused oil of 30 g for stirring was maintained at a temperature of 95° C. for 12 hours to produce experimented oil 22 ("unused oil+strong HT" in FIG. 4). Further, unused oil of 30 g with no additive agent was maintained at a temperature of 95° C. for 12 hours to produce experimented oil 23 ("unused oil" in FIG. 4). Each total acid value in the oil 21, 22, and 23 was measured.

As apparent from FIG. 4, total acid value of the oil 21 to which HT was added were generally the same as those of the oil 23 with no additive agent. On the other hand, total acid value of the oil 22 to which strong HT was added were approximately 5% of those of the oil 23 with no additive agent. These correspond to the event that HT shows a weak base in the oil and, strong HT shows a strong base in the oil.

Experiment Example 3

Further, a dispersion state of additive agents was visually examined in each of the oil 21 and 22 used in Experiment Example 2. HT generally precipitated in the oil 21 to which HT was added, and the oil 21 was not almost turbid. On the other hand, strong HT was generally in a dispersion state in the oil 22 to which strong HT was added, and the oil 22 was partly in a colloid state. Therefore, HT is remarkably appropriate as an additive agent to oil as compared to strong HT.

Experiment Example 4

Next, the result of experiments performed for examining an absorption capability to nitric acids in oil will be explained. The experiment result is shown in FIG. 5.

In this experiment, 3 mL of nitric acids of one normality were added to 27 mL of unused oil. In addition, mixture oil in which HT of 1 g was further added to the oil including the nitric acids for stirring was maintained at a temperature of 95° C. for 2 hours to produce experimented oil 41 ("unused oil+$HNO_3$+HT" in FIG. 5). Likewise mixture oil in which zirconium oxycarbonate of 1 g was further added to the oil including the nitric acids for stirring was maintained at a temperature of 95° C. for 2 hours to produce experimented oil 42 ("unused oil+$HNO_3$+zirconium oxycarbonate" in FIG. 5). Further, the oil including the nitric acids with no addition of the additive agent was maintained at a temperature of 95° C. for 2 hours to produce experimented oil 43 ("unused oil+$HNO_3$" in FIG. 5), and the unused oil with no addition of the additive agent was maintained at a temperature of 95° C. for 2 hours to produce experimented oil 44 ("unused oil" in FIG. 5). Each pH of the oil 41, 42, 43 and 44 was measured.

Figure 5:
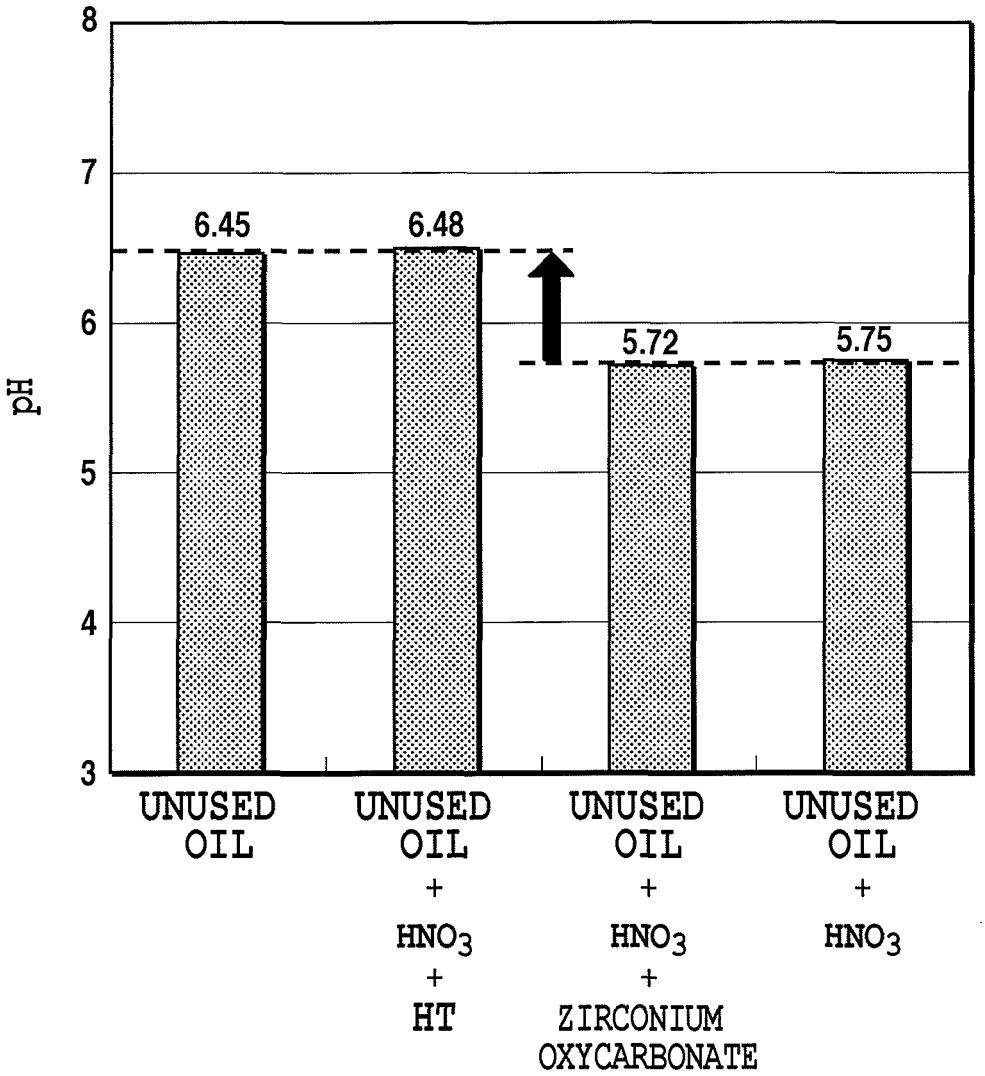
FIG. 5 is a graph showing an experiment result.

As apparent from FIG. 5, the unused oil 44 had a pH of 6.45, but the oil 43 to which nitric acids were added had a pH of 5.75. However, the oil 41 to which HT was added had a pH of 6.48. Judging from the present experiment, it is apparent that the nitric acids in the oil are sufficiently absorbed and removed by HT. In contrast, the oil 42 to which zirconium oxycarbonate was added had a pH of 5.72, and such an improvement of pH did not occur. Therefore, HT has a remarkably excellent absorption capability of acid components in the oil as compared to the zirconium oxycarbonate.

Experiment Example 5

Colors and odors of the oil 41, 43, and 44 produced in Experiment Example 4 were respectively compared. There was no difference in color and odor between the unused oil 44 and the oil 41 to which HT and the nitric acid were added. On the other hand, the oil 43 to which only the nitric acid was added had a color different from that of the unused oil 44 and emitted a sulfur odor. Also judging from this, it is apparent that HT has a sufficient absorption capability of acid components in the oil.

Experiment Example 6

Next, the result of experiments performed for examining absorption characteristics of acid components in HT will be explained. The experiment result is shown in FIG. 6.

In this experiment, a nitric acid solution having a predetermined concentration was delivered by drops into water (distilled water) having a predetermined amount of HT, and pH of the water after the dropping was examined. Specifically water W1 provided by adding 1 g of HT to 50 mL of distilled water for stirring, water W2 provided by adding 0.1 g of HT to 50 mL of distilled water for stirring, water W3 provided by adding 0.01 g of HT to 50 mL of distilled water for stirring, and 50 mL of distilled water W4 without HT were prepared. Meanwhile, a nitric acid solution H1 of 1M (mol/L), a nitric acid solution H2 of 0.1M, and a nitric acid solution H3 of 0.01M were prepared. In addition, the nitric acid solution H1 was dropped into water W1, the nitric acid solution H2 was dropped to water W2, the nitric acid solution H3 was dropped to water W3, and the nitric acid solution H3 was dropped to water W4, each by a predetermined amount for stirring. The water in one minute after the dropping was respectively made as experimented solutions 61, 62, 63, and 64, and pH of each of the experimented solutions was measured.

Figure 6:
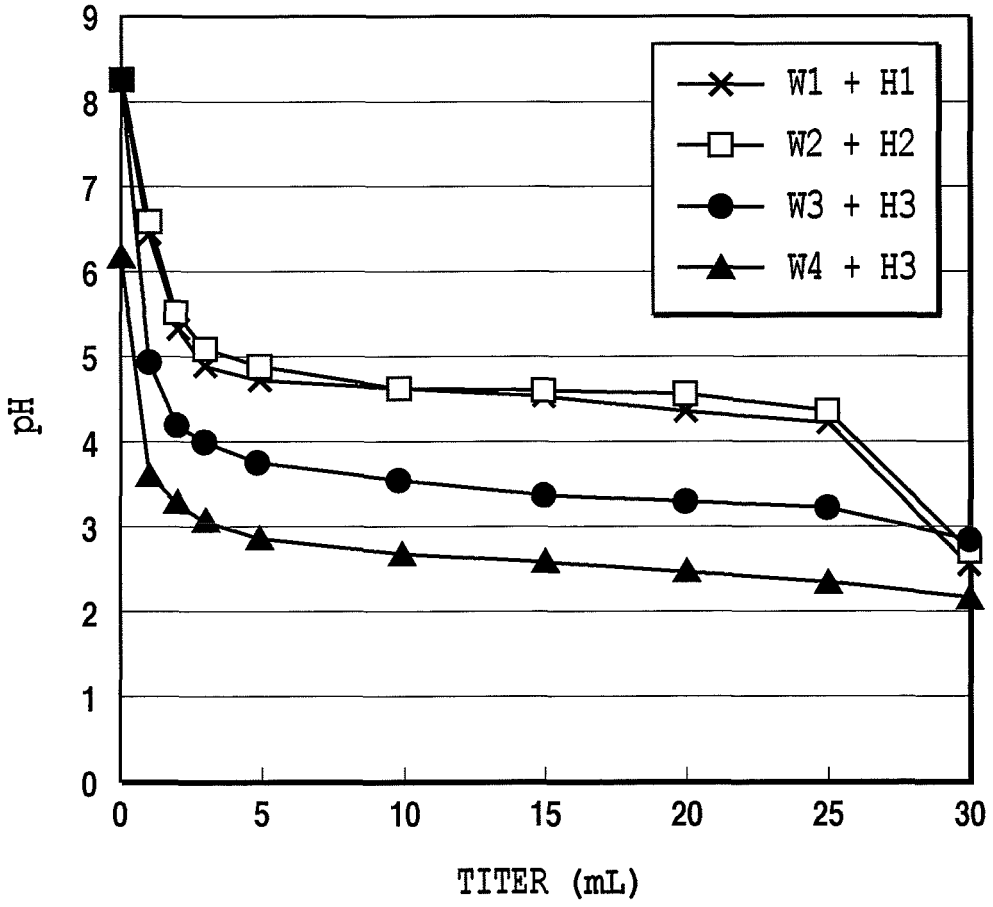
FIG. 6 is a graph showing an experiment result.

As a result, as shown in FIG. 6, the acid absorption effect by HT was found out as a whole. However, the experimented solution 61 produced by adding the nitric acid solution H1 having a strong acid concentration to water W1 and the experimented solution 62 produced by adding the nitric acid solution H2 having a strong acid concentration to water W2 were closer to neutral than the experimented solution 63 produced by adding the nitric acid solution H3 having a weak acid concentration to water W3. In this manner, the experimented solutions 61, 62, and 63, in each of which HT was added, showed a tendency that pH of each was the lower as the added acid was weaker. In consequence, it is apparent that HT has a more excellent absorption capability to a strong acid than a weak acid and HT has characteristics that capabilities of trapping acid components are increased as an acid level of the solution is the higher. Therefore, HT must achieve the excellent absorption effect of the acid component in the liquid in which the acid concentration has increased on some degree, specifically in the deteriorated oil.

Experiment Example 7

Next, the result of experiments performed for examining an effect to the deteriorated oil will be explained. The experiment result is shown in FIG. 7.

Figure 7:
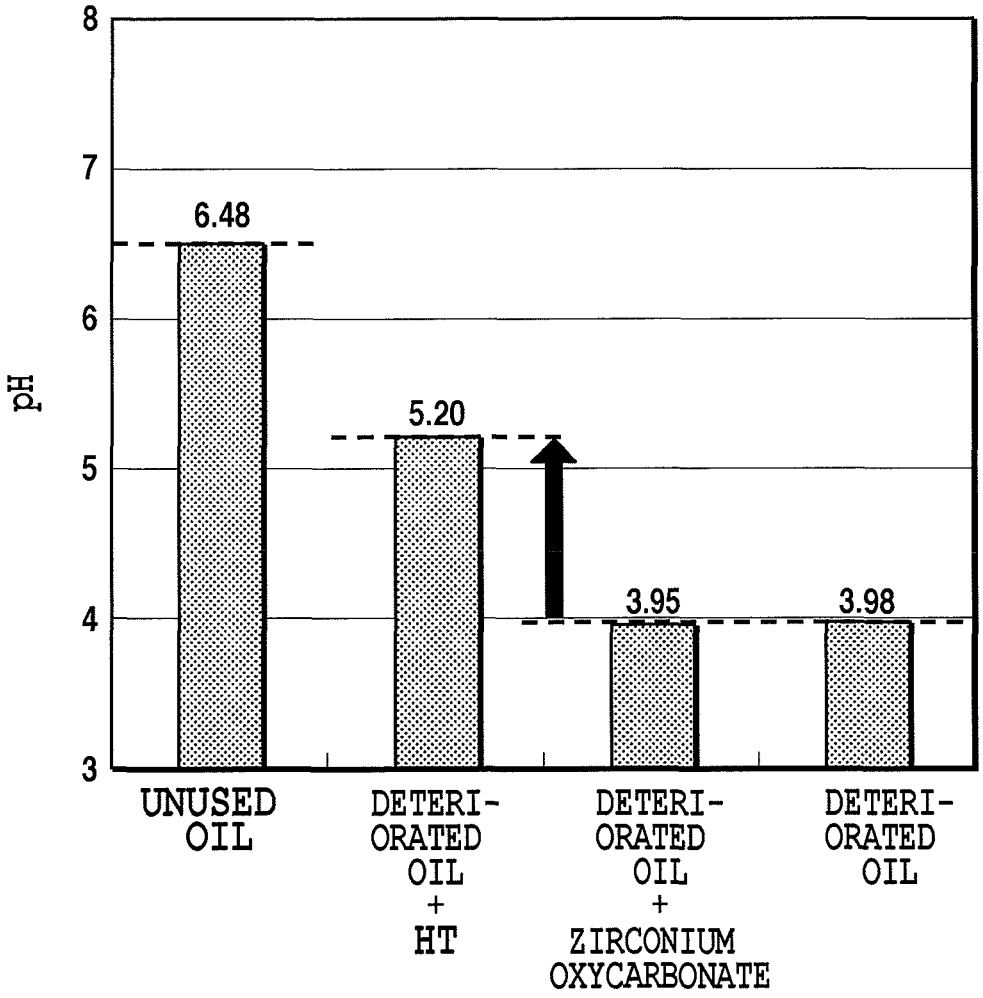
FIG. 7 is a graph showing an experiment result.

In this experiment, mixture oil in which HT of 1 g was added to 27 mL of deteriorated oil for stirring was maintained at a temperature of 95° C. for 2 hours to produce experimented oil 71 ("deteriorated oil+HT" in FIG. 7). Likewise mixture oil in which zirconium oxycarbonate of 1 g was added to 27 mL of deteriorated oil for stirring was maintained at a temperature of 95° C. for 2 hours to produce experimented oil 72 ("deteriorated oil+zirconium oxycarbonate" in FIG. 7). Further, the deteriorated oil with no addition of the additive agent was maintained at a temperature of 95° C. for 2 hours to produce experimented oil 73 ("deteriorated oil" in FIG. 7), and the unused oil with no addition of the additive agent was maintained at a temperature of 95° C. for 2 hours to produce experimented oil 74 ("unused oil" in FIG. 7). Each pH of the oil 71, 72, 73 and 74 was measured.

As apparent from FIG. 5, the unused oil 74 had a pH of 6.48, but the deteriorated oil 73 had a pH of 3.98. The oil 72 to which zirconium oxycarbonate was added had a pH of 3.95, and the oil 71 to which HT was added had a pH of 5.20. Also judging from the present experiment, it is apparent that HT has a remarkably excellent absorption capability of acid components in the oil.

Experiment Example 8

Next, the result of experiments performed for examining a sludge suppression effect in the deteriorated oil by a HT addition will be explained.

In this experiment, a kinetic viscosity of each of the oil 73 produced in Experiment Example 7 and the oil 71 to which HT was added was measured. The viscosity of the deteriorated oil 73 to which HT was not added was 300 cP or more. Meanwhile, the viscosity of the deteriorated oil 71 to which HT was added was on the order of 27 cP, and the oil 71 had flow characteristics as similar to that of unused oil. Therefore, it is apparent that acid components can be absorbed and removed from the oil by adding HT to the oil, and as a result, an excellent sludge suppression effect is brought.

Experiment Example 9

An experiment vehicle on which an engine having the same construction as the above engine 10 was mounted was used to examine an effect by HT. The experiment effect is shown in FIG. 8.

In this experiment, an oil filter as similar to the oil filter 36 accommodating HT was produced to be incorporated into the engine of the experiment vehicle at a predetermined time. 80 g of HT powder having an average particle diameter of 5 to 15 μm was accommodated in the oil filter used in the experiment. When an urban travel distance of the experiment vehicle reached 15.000 km, the oil filter was introduced into the experiment vehicle.

Figure 8:
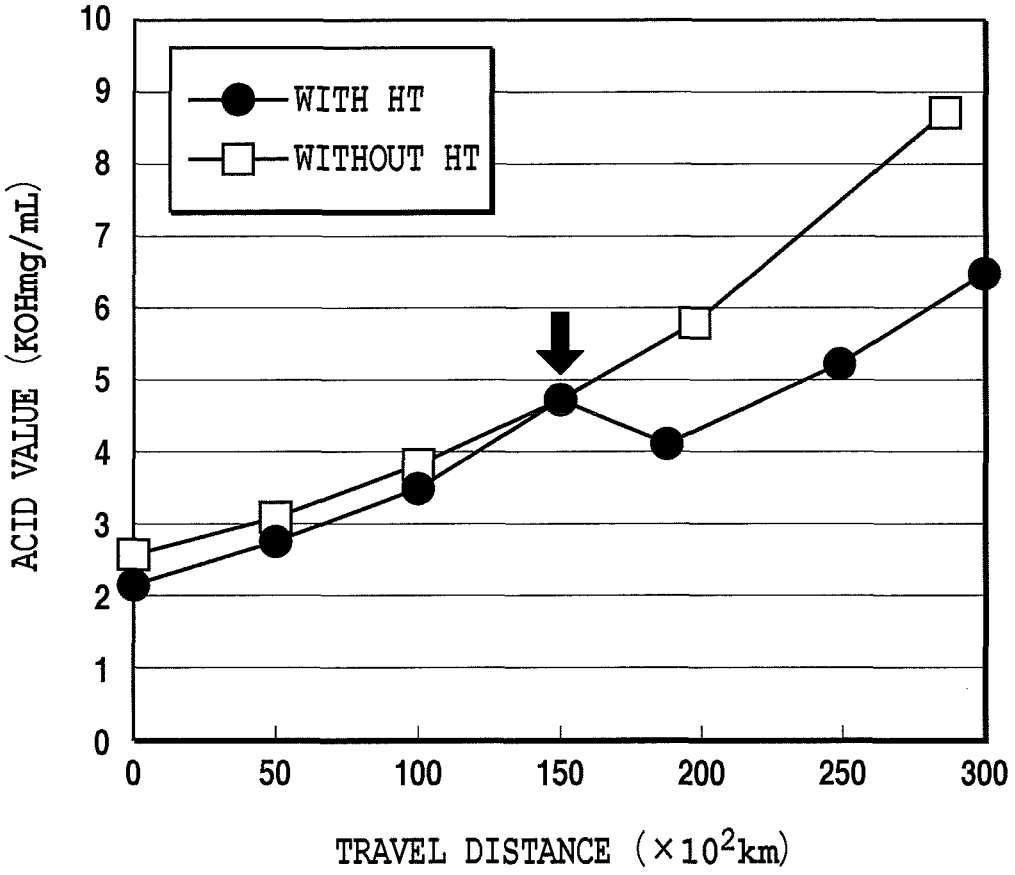
FIG. 8 is a graph showing an experiment result.

FIG. 8 shows a change in acid value of oil in the engine of the experiment vehicle in a case of introducing the oil filter having HT at the predetermined time, to the travel distance. Further, FIG. 8 likewise shows a change in acid value of oil in the engine of the experiment vehicle in a case of not introducing such an oil filter, that is, without HT. In FIG. 8, the time of introducing the oil filter is expressed in an arrow.

As apparent from FIG. 8, the acid value in the oil increased with an increase of the travel distance. Meanwhile, in a case of introducing the oil filter, that is, having HT, the acid value of the oil was lowered immediately after the introduction and an increasing speed of the acid value of the oil was slower thereafter. In this manner, the introduction of HT into the oil in the lubricating device of the engine contributes to a reduction of the acid value in the oil, therefore making it possible to suppress generation of sludge or the like.

It should be noted that it is certified that HT sufficiently achieves the absorption capability of acid components in the oil in a temperature range of a room temperature (for example, 20° C.) or more to 160° C. or less through the above experiments. However, a use region of HT can be preferably in a temperature range of 100° C. or less.

As described above, the present invention has been explained based upon the above embodiments, the modifications and the experiment examples. The present invention is, however, not limited to the aforementioned embodiments and allows other embodiments. The present invention includes all modifications, applications and the equivalents contained within the concept of the present invention as defined in claims.

The invention claimed is:

1. An additive agent to be added to engine oil, comprising:

weak basic hydrotalcite;

wherein the weak basic hydrotalcite has a composition of $$Mg_{8-x}Al_x(OH)_y(CO_3)_z.mH_2O,$$

wherein x is 2, y is 1 and z is 16 and m is a positive rational number.

2. An additive agent according to claim 1, wherein at the time of adding a mixture of hydrotalcite of 1 weight % and water by 3 weight %, with reference to a total amount of the mixture and the oil, to the oil for stifling, the oil indicating a hydrogen ion exponent within a range of 6 to 7, the weak basic hydrotalcite is hydrotalcite where the obtained oil indicates the hydrogen ion exponent within a range of 6 to 7.

3. An additive agent according to claim 1, wherein the weak basic hydrotalcite is hydrotalcite where a mixture of hydrotalcite of 3 weight % and water indicates a hydrogen ion exponent of 7 or more to 10 or less.

4. An oil filter comprising the additive agent according to claim 1.

5. An oil filter according to claim 4, further comprising an additive agent of hydrolyzing.

6. A lubricating device for a machine comprising the additive agent according to claim 1.

7. A lubricating device for a machine according to claim 6, further comprising an additive agent of hydrolyzing.

8. A lubricating device for a machine comprising the oil filter according to claim 4.

* * * * *